US006067915A

United States Patent [19]

Sharpe

[11] Patent Number: 6,067,915

[45] Date of Patent: May 30, 2000

[54] FEEDING SYSTEMS FOR A CONTINUOUS PYROLYSIS AND GASIFICATION PROCESS AND APPARATUS

[75] Inventor: John Ernest Elsom Sharpe, Beckenham, United Kingdom

[73] Assignee: Compact Power Limited, United Kingdom

[21] Appl. No.: 09/051,911

[22] PCT Filed: Oct. 25, 1996

[86] PCT No.: PCT/GB96/02618

§ 371 Date: Apr. 27, 1998

§ 102(e) Date: Apr. 27, 1998

[87] PCT Pub. No.: WO97/15640

PCT Pub. Date: May 1, 1997

[30] Foreign Application Priority Data

Oct. 26, 1995 [GB] United Kingdom ..... 9521950
Oct. 26, 1995 [GB] United Kingdom ..... 9521984

[51] Int. Cl.[7] ..... F23G 5/12

[52] U.S. Cl. ..... 110/346; 110/347; 110/342; 110/344; 110/109; 110/234; 110/229; 48/198.3; 48/197 R; 48/DIG. 4

[58] Field of Search ..... 110/341, 342, 110/344, 346, 347, 108, 234, 229, 255, 230, 109; 48/DIG. 4, 198.3, 197 R

[56] References Cited

U.S. PATENT DOCUMENTS

| | | | |
|---|---|---|---|
| 1,758,630 | 5/1930 | Trent . | |
| 3,708,078 | 1/1973 | Clements | 110/109 X |
| 3,855,950 | 12/1974 | Hughes, Jr. et al. | 110/109 X |
| 4,044,904 | 8/1977 | Trumbull et al. | 414/808 |
| 4,217,175 | 8/1980 | Reilly | 110/109 X |
| 4,318,713 | 3/1982 | Lee et al. | 48/203 |
| 4,495,872 | 1/1985 | Shigaki | 110/190 |
| 4,650,546 | 3/1987 | Le Jeune | 110/230 X |
| 4,732,092 | 3/1988 | Gould | 110/229 |
| 4,829,911 | 5/1989 | Nielson | 110/108 X |
| 4,852,504 | 8/1989 | Barresi et al. | 110/346 |
| 4,996,930 | 3/1991 | Yip et al. | 110/346 X |
| 5,280,757 | 1/1994 | Carter et al. | 110/346 |
| 5,311,830 | 5/1994 | Kiss | 110/346 |
| 5,400,726 | 3/1995 | Dumons | 110/346 |
| 5,485,812 | 1/1996 | Firey | 110/108 X |
| 5,634,414 | 6/1997 | Camacho | 110/346 |
| 5,657,706 | 8/1997 | Liagre et al. | 110/346 X |

FOREIGN PATENT DOCUMENTS

| | | | |
|---|---|---|---|
| 0 443 596 | 8/1991 | European Pat. Off. | C10B 53/00 |
| 43 27 320 | 3/1994 | Germany | C10B 53/00 |
| 262901 | 12/1936 | United Kingdom . | |
| 1057977 | 2/1967 | United Kingdom | C10J 3/50 |

*Primary Examiner*—Ira S. Lazarus
*Assistant Examiner*—Ljiljana V. Ciric
*Attorney, Agent, or Firm*—Bacon & Thompson, PLLC

[57] ABSTRACT

A method of charging a pyrolytic gas-producing reactor with waste fuel wherein the waste fuel is forced into the reactor by a ram and wherein air is prevented from entering the reactor and pyrolysis gases are prevented from escaping from the reactor by means of an ablative seal which is positioned between the fuel and the ram and which is forced by the action of the ram on the fuel charge into the reactor whilst in sealing engagement with the internal walls of the reactor, the seal being made of a material which will resist the high temperature and chemical conditions in the reactor for at least as long a period as is required for the seal to perform its sealing function and which is thereafter thermally decomposed into products which are not detrimental to the pyrolytic process or to the pyrolytic gases produced by the reactor. Also described is a method of feeding particulate materials into or through a tubular vessel which method comprises urging the material through the vessel, for example by ram means, and preventing or overcoming jamming of the packed particulate material by applying a neutral or negative force to the material at a position on the upstream side of the position at which jamming would otherwise occur.

9 Claims, 5 Drawing Sheets

FEEDING SYSTEMS FOR A CONTINUOUS PYROLYSIS AND GASIFICATION PROCESS AND APPARATUS

BACKGROUND OF THE INVENTION

1. Field of the Invention

The disposal of waste has become an increasing problem in recent years and the need to convert many forms of waste into energy has become apparent. However, this must be done in an environmentally acceptable manner and at reasonable cost.

2. Description of Related Art

There have been many attempts to convert waste into energy. The most commonly used to date has been incineration. However, this is becoming increasingly unacceptable on account of emissions and public reaction.

Potentially the most acceptable means of conversion of waste into energy is that by pyrolysis and gasification leading to the production of a fuel gas which is preferably oxidised whilst it is still hot to release the energy. Alternatively, the pyrogas may be condensed to yield a complex hydrocarbon oil and gas which may be burnt. However this is difficult within environmental constraints and the immediate combustion of the fuel gas is preferred.

Many of the pyrolysis and gasification systems which are used at present, or which have been proposed for use, employ rotational or moving conveyors or containers to feed, mix and agitate the waste material which is to be pyrolysed. However, there are many problems, particularly relating to the feeding and sealing of these rotational systems, and one of the purposes of the present invention is to solve these problems in an economic manner and at the same time provide an efficient continuous pyrolysis and gasification process which can be closely controlled. Additionally, the present invention enables effective feeding, mixing and agitation of the waste so that it is subjected to the pyrolysis and gasification process in a uniform manner.

In particular, the invention permits a wide range of waste materials to be continuously pyrolysed and gasified using the thermal reaction to heat the process in an integrated compact installation. The waste heat which is recovered can be used for power generation and the thermal drying of the waste.

In our co-pending U.K. Patent Application No. 9521984.6 there is described a process for the production of heat energy from solid carbonaceous fuels which process comprises subjecting the carbonaceous fuel to substantially anaerobic pyrolysis in at least one first zone and thereafter transferring the char resulting from the pyrolysis to a second zone which is segregated from the first zone or zones, the char being subjected to gasification in the second zone by introduction of primary combustion air, optionally with steam, the off gases from the second zone and the pyrolysis gases from the first zone or zones being thereafter subjected to secondary combustion and the first zone or zones being heated by heat derived from said secondary combustion, ash being removed from the bottom of the second zone. The present invention has particular applicability to such a process and apparatus, and provides a particularly efficient means of feeding carbonaceous fuel materials to the pyrolysis stage of such a process.

As previously mentioned there are problems in providing effective sealing of pyrolysis and gasification apparatus, particularly when involving moving parts, and particularly in the part of the apparatus where the carbonaceous fuel is introduced. Several kinds of mechanical charging arrangements are known involving various kinds of gates, air locks and ramming means. However, the moving parts of such mechanical arrangements tend to be complicated, are prone to both inward and outward gaseous leakage and also to jamming due to accumulation of the carbonaceous material and the pyrolysis products thereof. Moreover, the preferred form of pyrolysis reactor is a tube because this provides one of the most effective means of transferring heat to the material to be pyrolysed. However, in feeding systems involving the forcing of a particulate material into or through a tubular vessel it is found that due to the effect of friction, which is exacerbated for example if the tube is constricted, for example due to accidental damage to the interior of the tube, interior surface irregularity or intentional restrictions, for example in the form of devices for improving mixing and/or heat transfer, the fed material tends to jam in the tube, for example at such a restriction, and sometimes the application of a very significantly higher force than that needed to cause normal feeding into and through the tube may not even be sufficient to overcome the jamming. Moreover, such situations are, of course, wasteful of energy and are uneconomic in continuous production terms due to the interruptions in normal running which are caused by the jamming.

The present invention provides solutions to the above-mentioned problems which are inherent in the use of such reactors.

GB-A-1 057 977 discloses a method of feeding dry dust-like solid fuels to a high pressure gasification system by adding a volatile liquid hydrocarbon to the feed to make a semi-solid mixture which is pumpable.

DE-A-4 327 430 describes a device and procedure for the thermal disposal of waste in which compacted slugs of waste are initially passed into a heated degasification tube. However, no separate seals are provided in the tube and no reference is made to possible jamming of the slugs in the tube or how such jamming may be avoided.

GB-A-262 901 describes a process and apparatus for feeding solids into or removing solids from vessels under pressure involving forcing the solids through a tube by means of a piston or plunger, optionally including a gas-tight material in the tube at each stroke of the plunger. It is suggested to make the tube slightly conical in cross-section.

SUMMARY OF THE INVENTION

The present invention provides a solution to the phenomenon of frictional jamming of particulate materials when fed into reactors in that such jamming of said particulate material can be overcome or avoided by the application of a relatively small negative or neutral force inside the bulk of the rammed particulate material on the upstream side of the restriction. Thus it can be seen that the present invention proposes, in conjunction with the novel concept of an ablative seal, the additional novel combination of two means for achieving efficient movement of the charged feed through a reactor, namely a ramming charging means together with an unjamming or jamming prevention means, which may preferably take the form of a rotating screw, to facilitate passage of the particulate feed.

According to one aspect of this invention there is provided a method of charging a pyrolytic gas-producing reactor with waste fuel wherein the waste fuel is forced into the reactor by a ram and wherein air is prevented from entering the reactor and pyrolysis gases are prevented from escaping from the reactor by means of an ablative seal which is positioned between the fuel and the ram and which is forced by the action of the ram on the fuel charge into the reactor whilst in sealing engagement with the internal walls of the reactor; the seal being made of a material which will resist the high temperature and chemical conditions in the reactor for at least as long a period as is required for the seal to perform its sealing function and which is thereafter thermally decomposed into products which are not detrimental to the pyrolytic process or to the pyrolytic gases produced by the reactor.

In another aspect the present invention provides a process for the continuous pyrolysis and gasification or waste materials comprising feeding a waste material batchwise by ram action into a plurality of reactor tubes arranged substantially horizontally in a furnace duct, each batch of waste material being backed by an ablative seal against which the ram acts, the solid residue from the pyrolysis being discharged into one or more vertical reactors where gasification is performed, ash being removed from the bottom of the vertical reactor and gases from the pyrolysis and gasification processes being oxidised and held at least 1250° C. for two seconds before passing to the furnace duct which is maintained at about 1200° C. by the passage of the oxidised gases, the gases being then passed to a boiler and thereafter, if required, to a separate preheating duct surrounding the reactor tubes to effect preliminary drying of wet waste material.

The action of the ram on the fuel slug causes the ablative seal to be broken up as it enters the pyrolysis tube proper, the sealing function then being taken over by a second ablative seal which backs a second fuel slug which is meanwhile rammed into the charging end of the reactor tube. The first ablative seal or the fragments thereof are pyrolysed along with the waste material, the material of construction of the ablative seal being so selected that it becomes indistinguishable from the waste material from the point of view or the pyrolysis and gasification process. The seal may be made for example of fiberboard or any other suitable material. The thickness of the seal, which can be regarded as a kind of piston, is not particularly critical but will obviously depend to some extent on its material of construction. The seals may be ready-made and, for example, arranged to be fed one at a time into the tube at the rear or each fuel slug, or example from a magazine of a plurality of such seals. Alternatively, the seals may, for example, be punched to size by the movement of the feeding ram on each stroke, from a suitable sheet of blank material. Other possible ways of making the ablative seal include for example injecting styrofoam into a narrow void formed between waste material loaded in the tube and the face of the piston of the ram, the injection being for example through a hollow piston rod. By careful design of the seal, which will usually be shaped as a disc, in particular its dimensions, the seal may be made to lock or wedge into the tube and allow only forward motion of the waste fuel in front of it. The seals may be provided centrally with a hole or recess adapted to fit on a corresponding locating spigot on the ram, for example.

As mentioned above, the use of ablative seals as described above solves problems experienced previously in the sealing of pyrolysis and gasification apparatus. Additionally, however, the present invention, as is also mentioned above, provides a solution to the phenomenon of frictional jamming of particulate materials when fed into reactors. As has been explained, it has been discovered that such jamming of fed particulate materials can be overcome or avoided by the application of a relatively small negative or neutral force inside the bulk of the particulate material at a position on the upstream side of the position where jamming occurs. By the expression the application of a negative or neutral force is intended preferably to mean in the context of the present invention the introduction of a void which may, and often will, be only temporary, within the bulk of the particulate material.

Preferably the means by which such a void is created is a rotating means extending from downstream of the particulate material into the particulate material itself and having a part within the particulate material which has one or more projections extending radially from the axis of the rotating means so that when the rotating means is rotated a void is formed behind the projection or projections. Said rotating means may for example be a rotating screw or a rotating shaft having one or more pins on it.

Ramming as a method of charging has been found to be very effective and efficient, particularly when using pyrolysis tubes which have a relatively smooth and uniform internal diameter. However, as is the case with any tube which is filled with bulk material, and particularly one which contains any kind of restriction, the bulk material will tend to jam and it is often not possible to overcome the jam in the tube even by applying a very high force to the ram. However, it has been discovered that such jamming of waste material in a stationary pyrolysis tube can be overcome merely by the use of a relatively small neutral or negative force at a position on the upstream side of the restriction, in accordance with the invention. That such a small force should be effective in removing or preventing a jam in the rammed flow of the material is all the more surprising when one thinks of the very high forces which can be applied to the ram without success in freeing the jam. It should be mentioned that the above-described frictional jamming phenomenon will eventually occur whatever means are used to force the bulk material through the tube. For example screw means are the sole means of forcing the material through the tube the tube will eventually jam if completely filled with material.

Accordingly, the present invention also provides a method of feeding particulate materials into or through a tubular vessel which method comprises urging the material through the vessel, for example by ram means, and preventing or overcoming jamming of the particulate material in the restriction by applying a neutral or negative force to the material at a position on the upstream side of the restriction.

The invention also provides a process of charging a pyrolytic gas-producing reactor with waste fuel wherein the waste fuel is forced into the reactor by a ram and wherein air is prevented from entering the reactor and pyrolysis gases are prevented from escaping from the reactor by means of an ablative seal which is positioned between the fuel and the ram and which is forced by the action of the ram on the fuel charge into the reactor whilst in sealing engagement with the internal walls of the reactor; the seal being made of a material which will resist the high temperature and chemical conditions in the reactor for at least as long a period as is required for the seal to perform its sealing function and which is thereafter thermally decomposed into products which are not detrimental to the pyrolytic process or to the pyrolytic gases produced by the reactor wherein the effect of a restriction or restrictions in the pyrolysis tube to cause jamming of the fed waste fuel is overcome by applying a negative force at the upstream or piston side of the restriction.

The invention additionally provides a tubular vessel for receiving particulate materials comprising a ram means for introducing the particulate material into the vessel, and rotatable means extending from downstream of the position where jamming occurs and into the packed particulate material said rotatable means having at least one projection thereon which is capable of producing a cavity in said particulate material on the upstream side of the position where the material is jammed.

Details of aspects and embodiments of the present invention are shown in the accompanying drawings:

BRIEF DESCRIPTION OF THE FIGURES OF DRAWINGS

FIGS. 1*a* and 1*b* show diagrammatically a test apparatus demonstrating the unjamming feed aspect of the invention.

FIG. 2*a* represents diagrammatically in partial section the first part of a process and apparatus for pyrolysis and gasification according to the invention.

FIG. 2*b* shows an alternative charging arrangements to that shown in FIG. 2*a*.

FIG. 3*a* is a diagrammatic representation of the arrangement of the combustion process and showing the arrangement of the plurality of pyrolysis tubes in the combustion duct.

FIG. 3*b* shows diagrammatically the arrangement of a vertical array of four pyrolysis tubes as shown in FIG. 3*a* when predrying of wet waste material is to be performed;

DETAILED DESCRIPTION OF THE PREFERRED EMBODIMENT

Figure 1A:
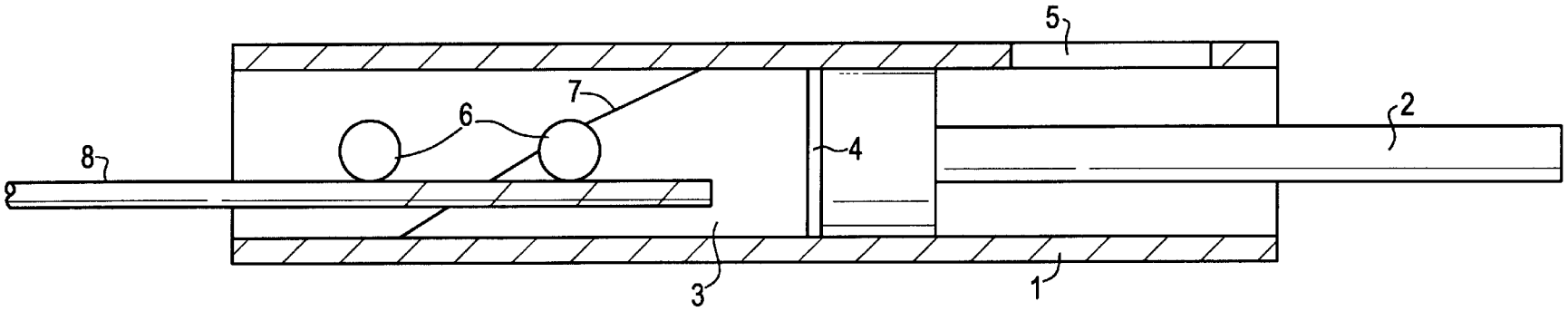
Figure 1B:
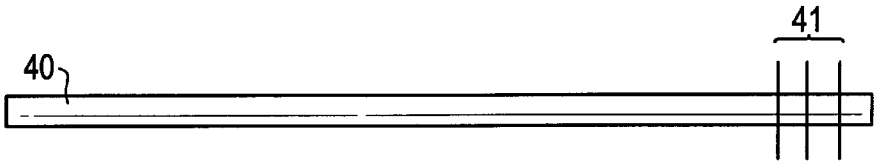

Referring firstly to FIGS. 1*a* and 1*b* tests were carried out following difficulties in feeding waste materials into a pyrolysing tube. Analysis of the situation suggested that once the natural repose of the material in the tube covered any restriction, the conditions were established for jamming of the feed piston. The angle of repose was approximately 30 degrees. It was discovered that if a negative force could be presented at a position on the upstream or piston side of the restriction this jam could be avoided but the advantages of a ram feed maintained.

A small test apparatus was constructed from a 200 mm length of 40 mm bore tube (1) into which was fitted a 25 mm long piston (2) attached to a long piston rod, as shown in the diagram. A breach (5) for feeding the waste material (7) to be tested was cut into the upper surface of the tube and two 6.5 mm diameter metal rods (6) were placed across the tube 30 and 70 mm from the open end to form restrictions to the movement of the material. Two systems have been used to provide the necessary void. Firstly a 6.5 mm diameter double start screw (8) was positioned under the restrictions and extending 20 mm beyond them, as shown in the diagram, and secondly a 4.0 diameter shaft having 3 pairs of pins 10 mm overall staggered along the shaft at 5 mm pitch as shown in FIG. 1*b*.

The force on the piston was measured with a spring balance and the screw was arranged to be driven at 500 rpm as required. The flight of the screw was approximately 2.5 mm.

The apparatus was tested with three materials, a lightweight aggregate of spherical form of between 2.5 and 3.5 mm diameter, granulated dried chicken litter of cylindrical for 2.5 mm diameter and between 2 and 5 mm long; and granular washing powder of between 1.5 and 2.5 mm.

Each material was loaded into the tube through the breach with the screw stationary. The material was pushed forward in front of a card seal (4) by the piston and refilled with a second charge which was also pushed forward to the position shown in the diagram. Here the piston jammed and forces in excess of 250 Newtons (N) were resisted. The angle of repose was similar for each of the materials with the 'free' surface passing through the first restriction as shown in the diagram.

As the motor was started and the screw rotated the previously jammed material was observed to flow freely past the restrictions and out of the free end of the pipe. The force required to move the piston fell at once to a very small value that was dependent on the material.

To move the piston and its support alone required 85 N.

With a rotating screw, Feeding lightweight aggregate the total force was 170 N, or 85 N to feed the material.

With a rotating screw, feeding chicken litter the total force was 95 N, or 10 N to feed the material.

With a rotating screw, feeding washing powder, the total force was 95 N or 10 N to feed the material.

The tests were repeated with the pinned shaft, which demonstrated that the materials may be forced through the restriction as the pins rotate. The forces on the piston were higher at 150 N or 65 N to feed the material. These tests demonstrate quite dramatically the effect of the invention and show that the concept of using for example a screw auger to produce a negative force on the granules ahead of any restriction is a very practical way of overcoming the jamming, as is also the use of the simpler system of a shaft with cross pins. The system retains the sealing advantages of the ram piston feed and the use of the ablative seal. Tests with thin card seals showed that they make no difference to the feeding rates or forces. Tests were carried out with seal discs (4) between different materials which enabled the feeding to be clearly seen.

Figure 2A:
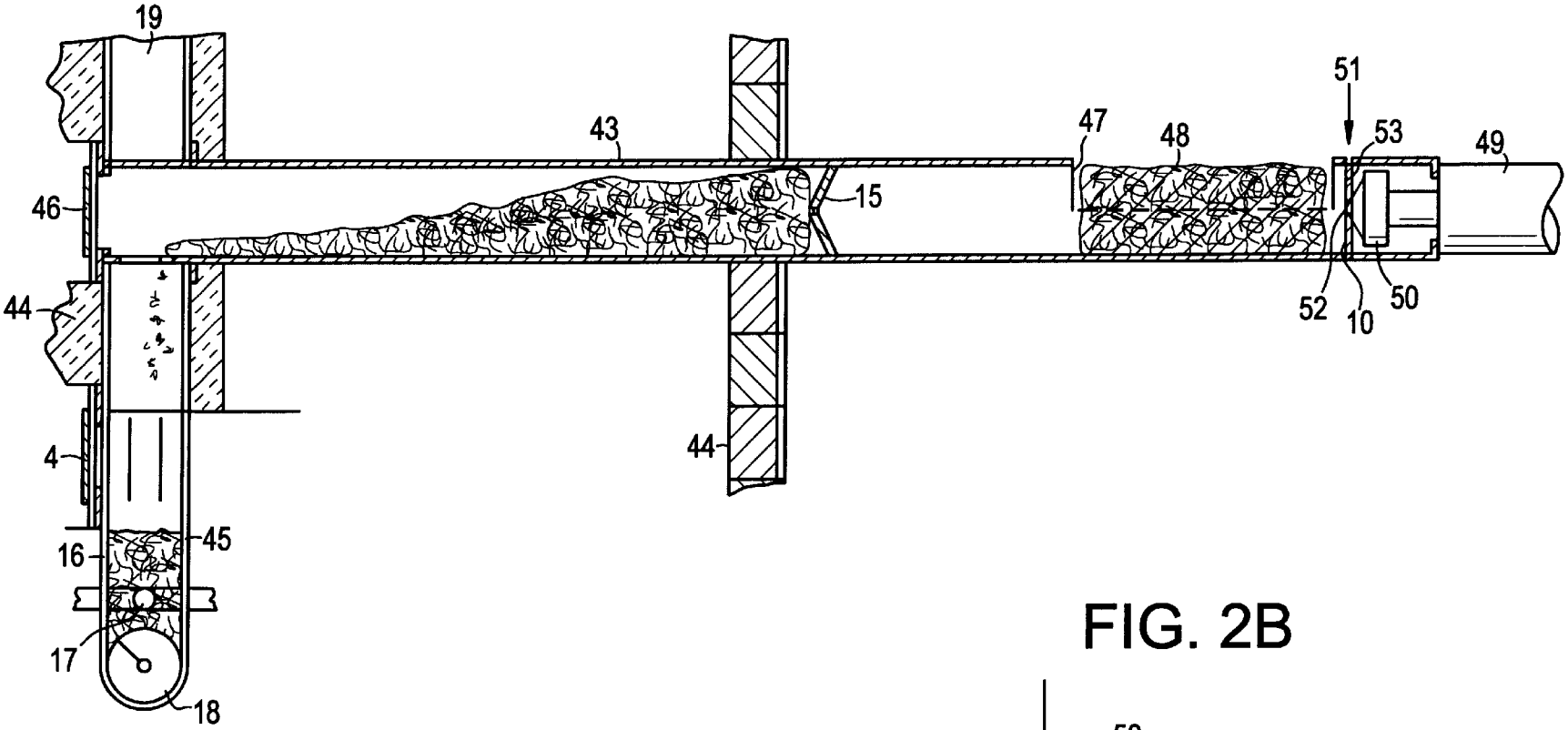

FIG. 2*a* shows a general arrangement illustrating just one reactor tube in conjunction with a single vertical gasifier. It should be borne in mind however that without departing from the scope of this invention more than one pyrolysis tube may be used in conjunction with a single gasifier and also that it is part of the concept of the present invention that not all of the pyrolysis tubes need to be in use simultaneously, thus providing redundancy, e.g. in the event of necessary repairs or cleaning, and enabling the apparatus to be kept in continuous use.

In FIG. 2*a* a pyrolysis reactor tube (43) is located partially within a refractory brick lined furnace (44) operating in a general temperature range of from about 800° C. to 1400° C. The width of the furnace through which the tube projects is typically about 2 meters and the reactor tube itself can be typically about a half meter in diameter. The reactor tube projects into a vertical gasifier (45) and faces a removable thrust cover (4) in the furnace wall on the opposite side of the gasifier tube.

The tube (43) extends outwards from the furnace wall on the side opposite the gasifier by a distance of 2 to 3 meters and has a breach (47) through which slugs or waste fuel (48) can be charged to the pyrolysis tube.

At the end of the tube (43) adjacent the breach (47) is a hydraulic cylinder (49) operating a ram (50). Between the breach (47) and the hydraulic cylinder (49) and ram (50) is located a feed means (51) for feeding ablative sealing discs (10) into the space between the loaded waste fuel slug and the head of the ram. The ram has a locating spigot (52) which cooperates with an orifice (53) in each sealing disc.

In the figure is shown a deformed sealing disc (15) where it has been positioned by the previous forward loading stroke of the ram in charging a fuel slug into the reaction tube. In the situation shown in the drawing the ram is about to make the next charging stroke when it will push forward both the newly fed sealing disc (10) and the fuel slug (48) which is in the breach (47) of the reactor tube. Further forward motion of the hydraulic ram causes the deformed sealing disc to enter the pyrolysing part of the tube at which time the newly-fed sealing disc having reached a position beyond the breach takes over the function of sealing the reactor tube whilst the charge of waste fuel already in the furnace-heated part of the reactor tube, along with the previous sealing disc, are pyrolysed by the applied heat. The forward ram stroke of the hydraulic ram is typically about 2.25 meters and the length of the fuel slug typically about 1 meter in this embodiment. However, it will of course be well understood that considerable variation in the dimensions mentioned in this example are possible and the invention is not limited to any specific dimensions of the apparatus used.

On reaching the gasifier end of the reactor tube the carbon char resulting from the pyrolysis process drops into the deep bed of the vertical gasifier where it is subjected to gasification by introduction of air and/or steam through the distributor (17). Ash is removed from the bottom of the gasifier by means of the screw (18). Meanwhile the mixture of gases from the gasifier and the pyrogas from the pyrolysis reactor tube mix and exit upwards at (19) to join the reaction gases produced from the other pyrolysis tubes as shown at (21) in FIG. 3*a*.

Figure 2B:
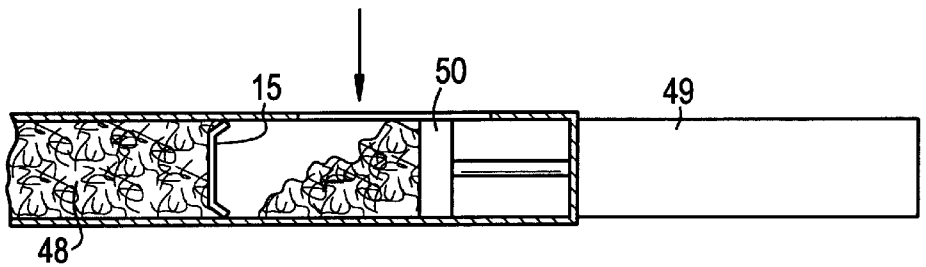

FIG. 2*b* shows an alternative charging arrangement in which instead of a slug or prepackage of waste material, loose particulate waste material is fed into the breach in the pyrolysis tube.

Figure 3A:
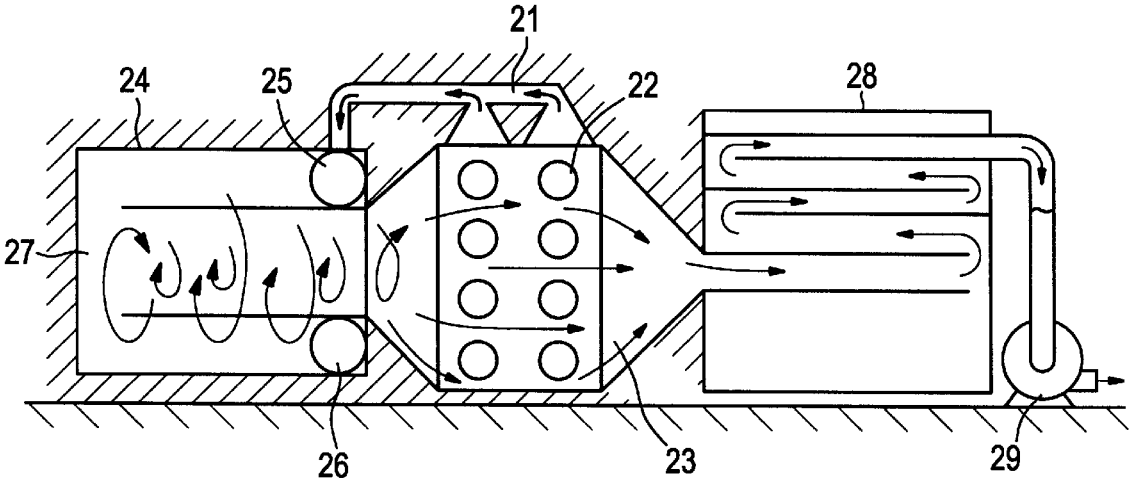

In FIG. 3*a* is shown a plurality, in fact eight, pyrolysis tubes (22) arranged in parallel in pairs one above another in a furnace (23) and forming two vertical columns each of four reactor tubes each vertical column feeding a vertical deep-bed gasifier (not shown in this Figure). As mentioned above, the furnace operates in the temperature range 800 to 1400° C. and the temperature of this order is produced in the thermal reactor (24) where the pyrogases and producer/water gas from the gasifier enter at (25) to be mixed with a fixed combustion air flow at (26) in a double vortex reactor (27) to produce the required temperature.

Downstream of the furnace is a boiler (28) with an exhaust fan (29). Waste gases from the boiler can be used to provide drying of wet waste fuels as shown in FIG. 3*b*.

The approximate dimensions of the particular apparatus shown in FIG. 3*a* are a length of about 12 meters and a height of about 4 meters. However, as mentioned above, there is no particular significance in these dimensions, except to show how compact the apparatus of this invention can be made.

The steam from the boiler will of course usually be used to generate electrical power by conventional means well known in the art.

Figure 3B:
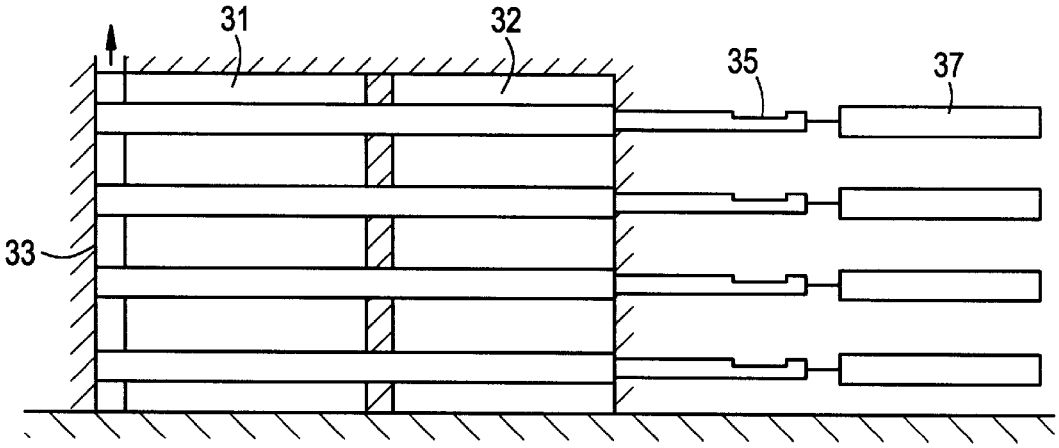

In FIG. 3*b* there is shown diagrammatically a particular arrangement which can be used for handling wet waste fuels which are not suitable to be subjected directly to pyrolysis treatment without preliminary drying. In FIG. 3*b* therefore the reactor tubes are positioned through two adjacent chambers, the second (31) being the furnace operating at 800 to 1400° C. as previously described but the first (32) being a drying chamber operating at 200 to 500° C. using hot exhaust gas from the boiler, the arrangement of the breach (35) in the reactor tubes, the hydraulic ram (37) and gasifier tube (33) being otherwise virtually identical with the arrangement shown in FIG. 1, each of the two vertical arrays of pyrolysis tubes opening into a common gasifier tube (33).

It will be appreciated that when using relatively wet waste the ablative sealing disc aspect of the present invention potentially enables wet waste to be handled in the reactor tubes without the kind of problems inherent in, for example, moving belt systems.

As mentioned above FIG. 4, diagrammatically shows an apparatus generally similar to that shown in FIG. 2*a* except that in this case the feeding ram acts at an acute angle to the pyrolysis tube proper and also in the pyrolysis tube itself there is provided screw feed means for preventing jamming or for unjamming the feed in the pyrolysis tube.

Figure 4:
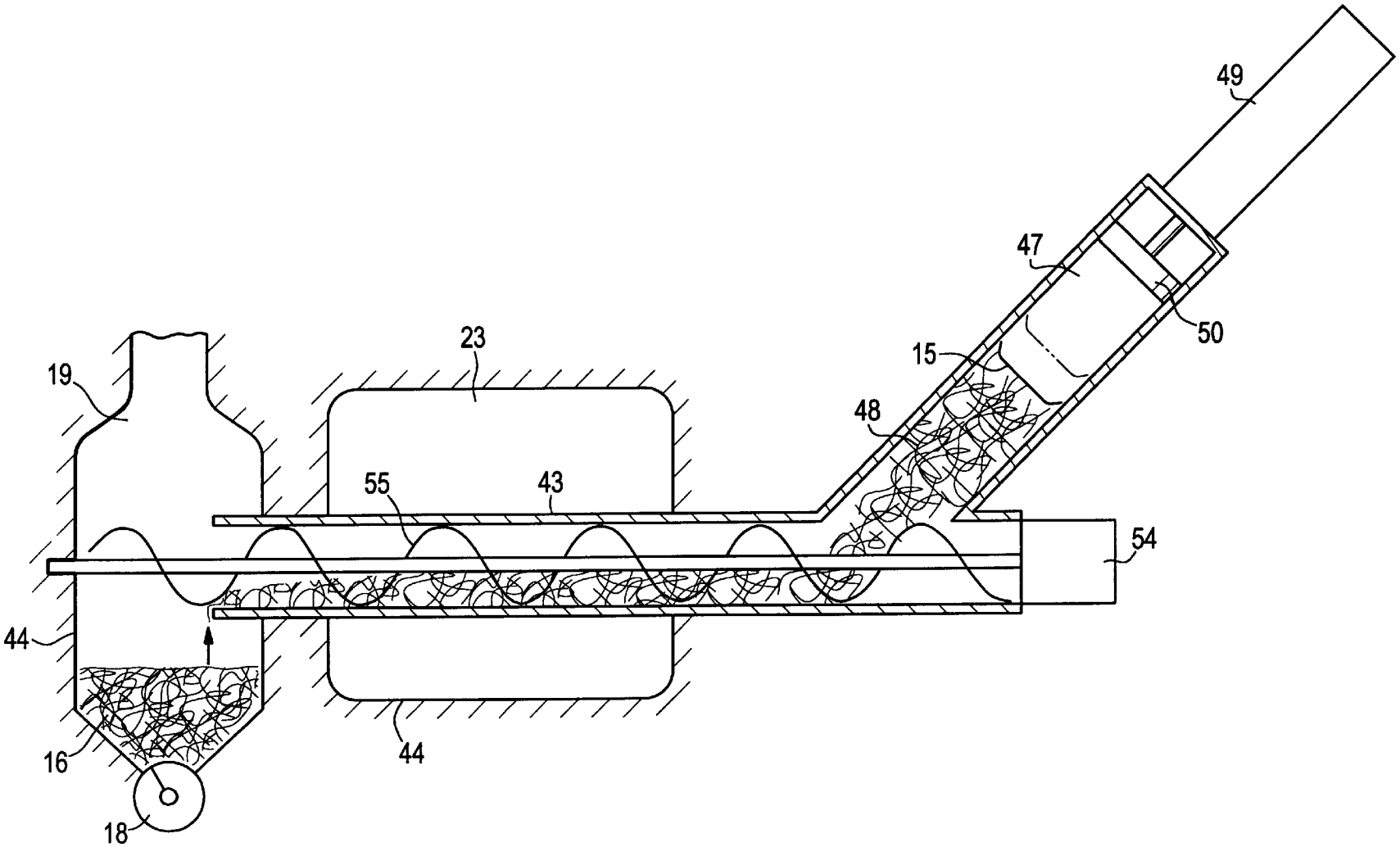
FIG. 4 shows a diagrammatic arrangement in vertical section of the first part of a pyrolysis and gasification process in which a feeding ram is arranged obliquely to a pyrolysis tube for inserting a charge of waste fuel material using ablative seals into a pyrolysis tube which is fitted with a screw drive in order to prevent jamming of the feed through the pyrolysis tube.
Figure 5:
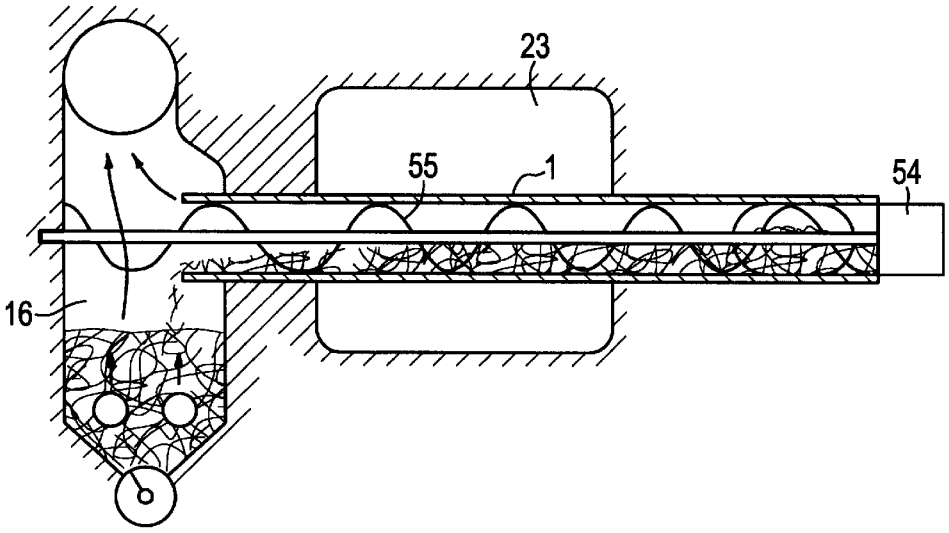
FIG. 5 and FIG. 6 show respectively vertical and plan section diagrams of the type of arrangement shown in FIG. 4 showing the use of two pyrolysis tubes and showing in outline a double vortex flow thermal reactor for heating the pyrolysis tubes.
Figure 6:
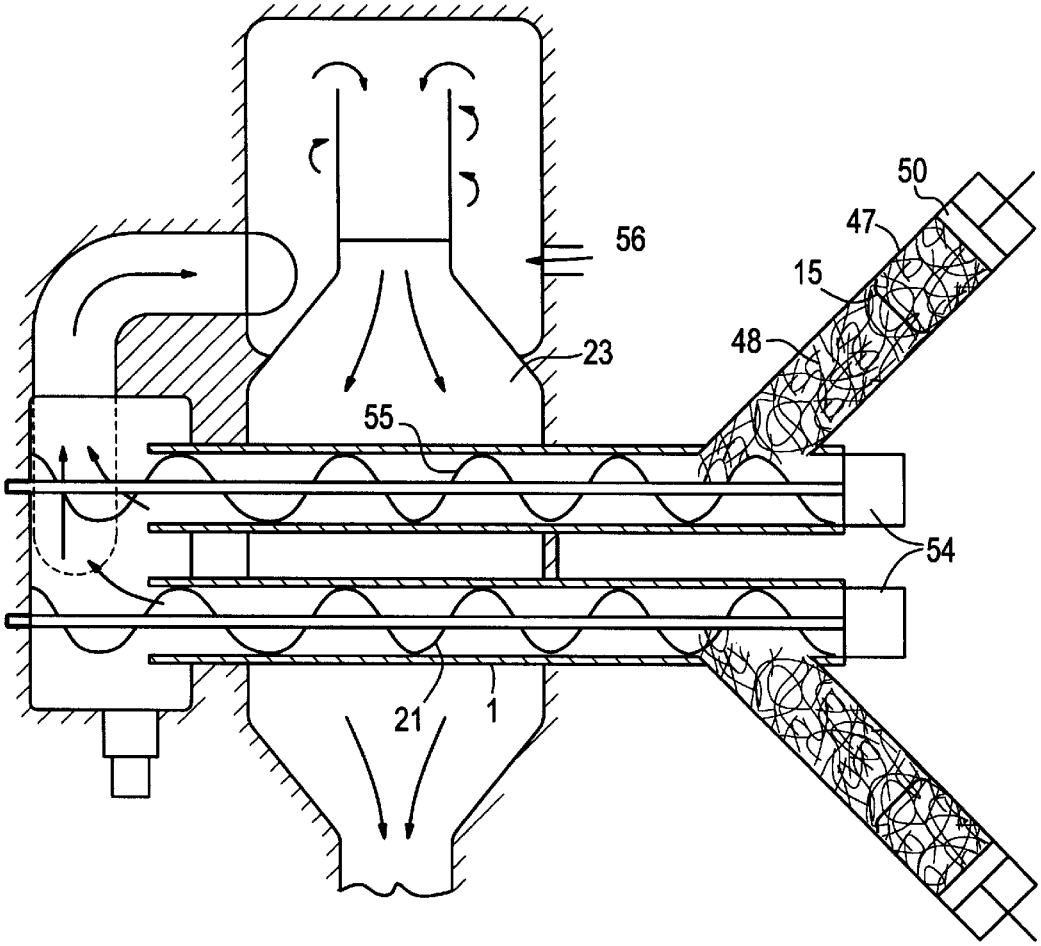

In FIGS. 5 and 6 there are shown respectively in more detail a vertical section and a plan view of apparatus similar to that shown in FIG. 4 but using two pyrolysis tubes and associated ram feeds and screw feed means with the use of ablative seals. In FIGS. 4, 5 and 6 the reference numerals used correspond to those in FIGS. 2*a* and 3*a* for corresponding features but additionally 54 and 55 are used to denote respectively the screw drive and screw feed means, and 56 represents the introduction of secondary air to the secondary combustion furnace.

Numerous other preferred and/or alternative arrangements falling within the scope of the invention will be apparent from the above description and the accompanying drawings.

It will be appreciated that the present invention provides a very compact means of converting waste to energy and furthermore by use of the cyclonic thermal reactor ensures that all gaseous emissions pass through an oxidising zone at at least 1250° C. with a residence time of two seconds, in order to satisfy environmental considerations.

I claim:

1. A process for the continuous pyrolysis and gasification of waste particulate materials comprising feeding a waste material batchwise by ram action into at least one reactor tube arranged substantially horizontally in a furnace duct, pyrolyzing said waste material in said reactor tube to produce a solid residue and pyrolysis gases, discharging the solid residue and the pyrolysis gases into at least one vertical reactor, gasifying the solid residue in the vertical reactor to produce ash and gasification gases, removing the ash from the bottom of the vertical reactor, oxidizing and holding the pyrolysis and gasification gases at at least 1250° C. for two seconds, passing the oxidized pyrolysis and gasification gases to the furnace duct which is maintained at 1000° C. by the passage of the oxidized gases and, thereafter, passing the oxidized gases to a boiler, wherein air is prevented from entering and pyrolysis gases are prevented from escaping from the reactor tube by backing each batch of waste material in the reactor tube with a separate ablative seal positioned between the waste material and the ram and forcing said ablative seal ram action on the waste material into the reactor tube whilst in sealing engagement with the internal walls of the reactor tube, said seal being made of a material which will resist the high temperature and chemical conditions in the reactor for as long a period as is required for the seal to prevent air from entering into and pyrolysis gases from escaping from the reactor tube and said seal thereafter being thermally decomposed into products which are not detrimental to the pyrolytic process or to the pyrolytic gases produced by the reactor and wherein jamming of the packed waste material in the reactor tube is prevented or overcome by forming an at least temporary void or cavity in the packed waste material.

2. A process as claimed in claim 1 wherein the ablative seal is adapted by virtue of its shape and material of construction to lock or wedge in the reactor tube and allow only forward motion of the waste.

3. A process as claimed in claim 1 wherein the ablative seal is adapted to be shaped by the ram.

4. A method as claimed in claim 1 wherein the cavity is formed by a rotating means extending from downstream of the packed particulate material, and into the packed particulate material itself, the rotating means having one or more projections so that when the rotating means is rotated a void in the packed material is formed.

5. A method as claimed in claim 4 wherein the rotating means is a rotating screw.

6. A method as claimed in claim 5 wherein the rotating means is a shaft having one or more projections, for example pins, on it.

7. A process as claimed in claim 6, wherein said projections are pins.

8. A process as claimed in claim 7, further comprising passing the oxidized gases from the boiler to a separate preheating duct surrounding the reactor tubes to effect preliminary drying of wet waste material.

9. A process as claimed in claim 1, wherein the waste material is fed batchwise to a plurality of reactor tubes arranged substantially horizontally in a furnace duct.

* * * * *